US005507054A

United States Patent [19]

Blauert et al.

[11] Patent Number: 5,507,054

[45] Date of Patent: Apr. 16, 1996

[54] METHOD FOR DETERMINING THE MASS OF WET LAUNDRY IN A LAUNDRY DRUM

[75] Inventors: Peter Blauert; Frank Böldt; Martina Wöbkemeier, all of Berlin; Paul T. Pilgram; Ulrich Rehfuess, both of München, all of Germany

[73] Assignee: Bosch-Siemens Hausgeraete GmbH, Munich, Germany

[21] Appl. No.: 328,467

[22] Filed: Oct. 25, 1994

[30] Foreign Application Priority Data

Oct. 25, 1993 [DE] Germany ..... 43 36 349.0

[51] Int. Cl.[6] ..... D06F 33/02

[52] U.S. Cl. ..... 8/159; 68/12.04; 68/12.12; 68/24

[58] Field of Search ..... 8/159; 68/12.01, 68/12.02, 12.04, 12.12, 24

[56] References Cited

FOREIGN PATENT DOCUMENTS 0345120 12/1989 European Pat. Off. ..... 68/12.04

4122307 1/1993 Germany ..... 68/12.01

215288 9/1991 Japan ..... 68/12.01

*Primary Examiner*—Philip R. Coe

*Attorney, Agent, or Firm*—Herbert L. Lerner; Laurence A. Greenberg

[57] ABSTRACT

A method for determining a mass of wet laundry in a washing machine drum being driven by an rpm-controlled universal motor is performed with the aid of controller variables. The drum is operated before and/or during a spin cycle within first, second and third phases in a mass determining segment. The drum is operated in the first phase with a delayed rpm rise up to a final rpm above an application rpm at which the laundry is applied to a wall of the drum, and near but below a resonant rpm of a drive system. The drum is operated in the second phase with a constant command rpm equal to the final rpm of a ramp. The drum is operated in the third phase with an rpm running down to a minimum rpm without being driven, and with the rpm still being high enough to prevent a previously developed ring of laundry from separating or more than slightly separating from the drum wall. A length of time is measured from a time when the drive is shut off until a time when the minimum rpm is reached, as a gauge for the mass of the laundry.

7 Claims, 1 Drawing Sheet

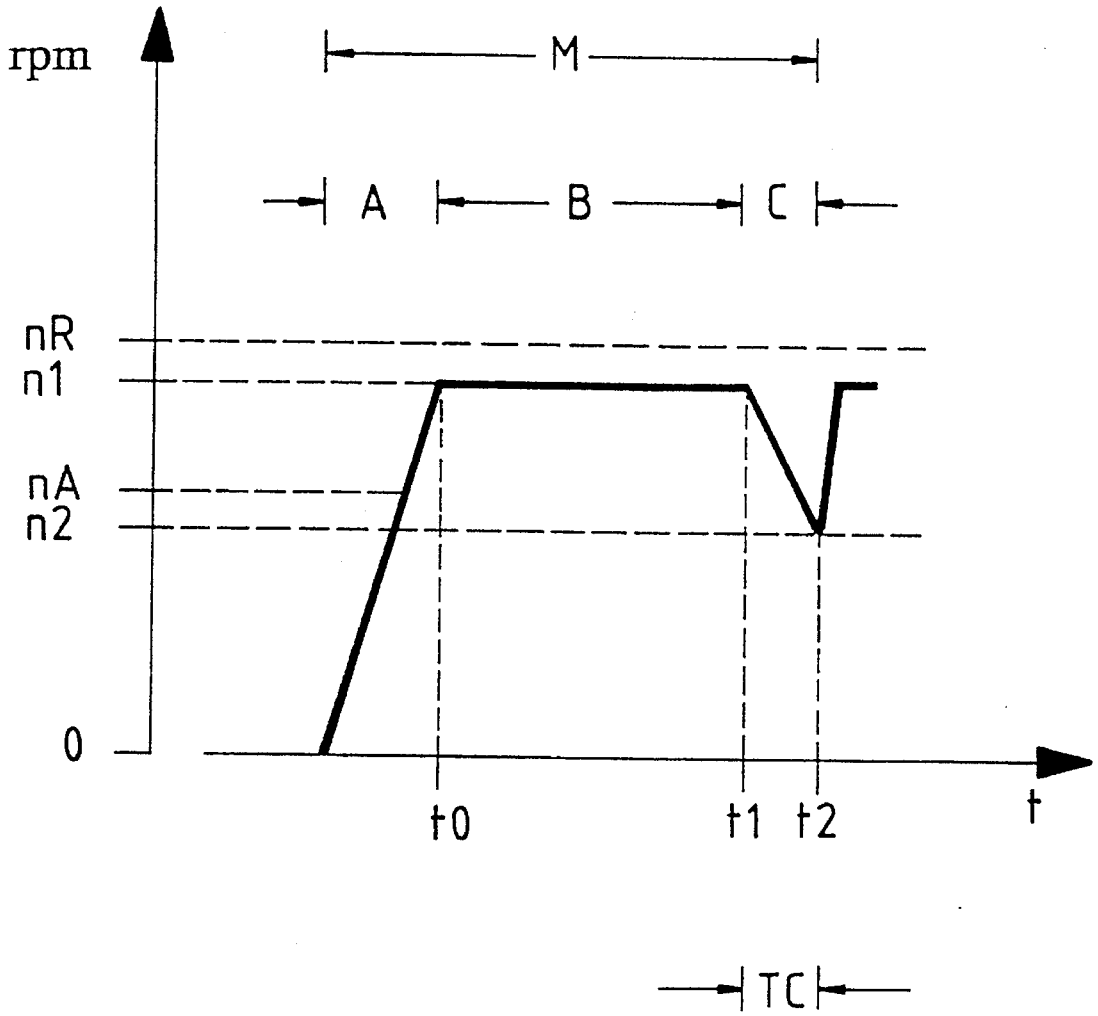
rpm
M
A
B
C
nR
n1
nA
n2
0
t0
t1
t2
t
TC

METHOD FOR DETERMINING THE MASS OF WET LAUNDRY IN A LAUNDRY DRUM

BACKGROUND OF THE INVENTION

Field of the Invention

The invention relates to a method for determining the mass of wet laundry in a washing machine drum being drivable by an rpm-controlled universal motor, with the aid of controller variables.

One such method is known from Published European Application No. 410 827. In that method, the mass of laundry is determined during the startup phase at constant acceleration. In that phase, the phase angle and the magnitude of the supply voltage are measured, and are used to calculate the mass inertia of the laundry by taking engine constants and the acceleration performance of the empty drum into account. Since the drum dimensions and the acceleration are known, a conclusion as to the mass can also be drawn from the calculated value for the mass inertia. Since the laundry in the drum still tumbles about forcefully during the startup process until it has distributed itself firmly in a ring of laundry on the inside of the drum wall, it is extraordinarily difficult to keep the acceleration constant from phase to phase. Deviations from the command value for the acceleration can therefore not be precluded. Occasionally, a uniform ring of laundry may not be attainable either, for instance because the laundry load includes relatively large pieces that are incapable of uniform fixation in the ring of laundry since their centers of gravity are sometimes much closer to the axis of the drum, and the requisite centrifugal force is not imparted to them. In such cases, the measurement of the supply voltage phase angle becomes imprecise, because even the slightest deviations from the even number of drum revolutions during the startup phase are expressed in major inaccuracies. Moreover, the measurements of the magnitude of the supply voltage and of the phase angle require special instruments, which are not otherwise needed for controlling the speed of the universal motor.

SUMMARY OF THE INVENTION

It is accordingly an object of the invention to provide a method for determining the mass of wet laundry in a laundry drum, which overcomes the hereinafore-mentioned disadvantages of the heretofore-known methods of this general type, which improves the accuracy of such a method and which simplifies the realization of the method as much as possible by dispensing with additional components.

With the foregoing and other objects in view there is provided, in accordance with the invention, in a method for determining a mass of wet laundry in a washing machine drum being driven by an rpm-controlled universal motor, with the aid of controller variables, the improvement which comprises operating the drum before and/or during a spin cycle within first, second and third phases in a mass determining segment, by operating the drum in the first phase with a delayed rpm rise up to a final rpm above an application rpm at which the laundry is applied to a wall of the drum, and near but below a resonant rpm of a drive system; operating the drum in the second phase with a constant command rpm equal to the final rpm of a ramp; and operating the drum in the third phase with an rpm running down to a minimum rpm without being driven, and with the rpm still being high enough to prevent a previously developed ring of laundry from separating or more than slightly separating from the drum wall; and measuring a length of time from a time when the drive is shut off until a time when the minimum rpm is reached, as a gauge for the mass of the laundry.

Below the resonant rpm of the driving system, at which deflection initiated by the imbalanced drum has a frequency below the resonant frequency of the vibratingly suspended drive system, the washing machine drum still runs comparatively quietly and with little deflection. Since during the slow rise in rpm in the startup phase the laundry has generally distributed itself somewhat uniformly on the drum wall, the opportunity exists during the second phase of detecting an unacceptable amount of imbalance in the distribution of the laundry caused by a fluctuation in rpm, and, by determining the mean phase lead angle of the controlled motor voltage, of ascertaining the typical flexing work of the belt for that particular machine, as well as bearing friction and possibly friction losses in shock absorbers if there is an imbalanced distribution of laundry. Findings as to those values are significant for evaluating the magnitude of the duration from the moment upon shutoff of the drive until the moment when the minimum rpm is reached during the third phase, with a view toward determining the mass of the laundry.

In accordance with another mode of the invention, during the second phase, the mean power of the drive motor is determined, which is a gauge for the braking moment of the drum that is taken into account as a variable in determining the mass. As explained above, the braking moment can be caused by flexing work of the belt, by bearing friction and by friction losses in the shock absorbers. This last parameter then always produces a pronounced value if the drum runs unbalanced and the resultant deflection undergoes feedback from the shock absorbers.

In accordance with a further mode of the invention, on the assumption of a constant mains voltage, the mean phase lead angle of its rpm control device is determined in order to determine the capacity of the drive motor. If slight fluctuations in mains voltage are ignored, then ascertaining the mean phase lead angle assures an adequately precise determination of the capacity of the drive motor. From this capacity determination, a conclusion can in turn be drawn about the braking moment at the drum. This needs no additional components, because the value of the phase lead angle is already available from the speed control process.

In accordance with an added mode of the invention, assuming that the mains voltage is not constant, and taking this fact into account, a mains voltage measurement is provided in addition to the determination of the phase lead angle, the outcome of which is taken into account as a correction value in determining the braking moment. As a result, the determination of the braking moment can be carried out again more accurately. The additional effort and expense are slight and only include one additional voltage divider on the wiring board of the rpm control device and one analog/digital converter, which is already normally available in the microprocessor.

In accordance with an additional mode of the invention, at least one further mass determination is made during the spin cycle, and the progress of the spin cycle is then ascertained from the results of the various mass determinations.

In accordance with yet another mode of the invention, a value from a further mass determination is compared with a value of a determination of the mass of the dry laundry carried out before or at the beginning of a preceding washing process, in order to determine the ascertained spin action in the form of a value for any residual moisture still remaining. Depending on the outcome of this comparison, the spin cycle can be terminated as a function of the status. This is especially advantageous because until now there was no other possibility of using the effect of the spin cycle as a criterion for ending it with laundry loads especially including various items of laundry with different absorptiveness.

In accordance with a concomitant mode of the invention, in the event that a mass determination was not carried out at the beginning of the preceding washing process, then the residual moisture can still advantageously be determined by comparing the value from the further mass determination with the value from the mass determination preceding it, and drawing a conclusion as to the residual moisture present in the further mass determination, using a value for the laundry absorption determination carried out before or at the beginning of the preceding washing process. Since a direct or indirect determination of the absorptiveness of the laundry is carried out anyway in modern washing machines at the beginning of the washing process, and an automatic adjustment of the quantity of water is based on this finding, the result of this determination can serve as a gauge for determining the residual moisture after the mass of the wet laundry has been determined.

Other features which are considered as characteristic for the invention are set forth in the appended claims.

Although the invention is illustrated and described herein as embodied in a method for determining the mass of wet laundry in a laundry drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is an rpm profile diagram with which the method of the invention will be described below in terms of an exemplary embodiment.

DESCRIPTION OF THE PREFERRED EMBODIMENTS

Referring now to the single FIGURE of the drawing in detail, there is seen a diagram which shows an rpm profile that can be employed at the beginning of a spin cycle. The rpm is therefore plotted over time in the diagram. A washing machine drum is first slowly accelerated from a standstill up to a final rpm n1 until a time t0. This rpm n1 is above an application rpm nA, at which the pieces of laundry located in the drum are wrapped against the inside of the drum wall and gradually distribute themselves generally in such a way that the items of laundry are placed somewhat uniformly on the periphery of the drum. As a result, the imbalance of the drum remains within tolerable limits. These limits can be monitored during a first startup phase A within in a mass determining segment M, until the time t0 by observing the uniformity of a rise in speed from a tachometer signal or from a "phase lead angle" variable of a control device for the drive motor. If these limits are exceeded, then the startup phase can be stopped immediately and restarted. However, the final rpm n1 is below a resonant rpm nR, which is determined by the system of the wash water container unit, which is suspended resiliently and with shock absorption. A vibrating system always has a resonant frequency at which the wash water container unit in the present case would vibrate if the drum were loaded in an imbalanced manner and driven at an angular speed corresponding to the resonance. In this case, the vibration amplitudes would reach a maximum at which sufficiently accurate measurements of the braking moment of the drum would no longer be possible.

At the time t0, the drive of the washing machine drum is supplied with a voltage that is equivalent to a constant command or set point rpm n1. During a second phase B up to a time t1, the power injected into the drum by the drive motor can be ascertained by observing the mean phase lead angle of the rpm control device. Although this power can be considered constant within certain limits and made a precondition from the outset for the further determination of the mass of laundry within a third phase C, nevertheless in order to improve the accuracy of the mass determination it is advantageous to ascertain the drum braking moment in the second phase B through the input power of the drive motor, so that this braking moment will be available in the form of a variable computed value in determining the laundry mass in the third phase C. Braking moments at the drum can be produced by bearing friction, as well as from flexing work carried out by the drive belt. If there is significant deflection of the wash water holder unit from an imbalanced distribution of laundry in the drum, the drum is also braked by the fact that the energy is destroyed by deflections in damping elements of the wash water holder unit. All such braking moments acting upon the drum are observed summarily by observing the phase lead angle of the rpm control device and are processed to form a mean value that is taken into account in the determination of the laundry mass in the third phase C.

The third phase C begins at the time t1 and ends at a time t2. At the time t1, the drive motor is turned off. The drum immediately begins a phase of slowing down to a stop, within which phase its rpm drops to a value n2 by the time t2. The rpm n2 is still high enough to cause the items of laundry that were previously organized in the laundry ring to still stick to the drum wall or to just then begin to detach from it. A length of time TC between the times t1 and t2 during the run-down phase C is measured and can be used in comparison with the previously ascertained braking moment for calculating the amount (mass) of laundry contained in the drum.

In the case of an imbalanced load of laundry, the time t1 should be chosen in such a way that the center of the imbalanced mass always has the same rotational angle position. Time t1 can be determined especially easily to a fixed point by always performing the shutoff at an extreme value for the fluctuating angular speed (minimum or maximum), or always performing it at a passage through the command or set point rpm, always in the same direction.

When the rpm of the drum as it runs down reaches the lower rpm limit n2, the motor is turned on again and the spin cycle is begun. The length of time TC between the shutoff time t1 and the time t2 when the motor is turned on again is measured. By including either the previously determined braking moment of the drum or the braking moment of the drum ascertained by the preceding phase B, the mass of the laundry can be calculated from the length of time TC, by way of calculating the moment of inertia of the load of laundry.

In order to increase the accuracy in calculating the mass of the load of laundry, the injected drive motor power can be determined more accurately in the phase B through the phase lead angle. In order to provide the power determination described above, a constant operating voltage was assumed first. However, it has been found that the operating voltage can certainly fluctuate from one treatment cycle to another. Through the use of a further feature of the invention, the input power of the drive motor can then be calculated even more accurately during the phase B by taking voltage fluctuations into account. This requires a device for detecting the magnitude of the operating voltage, which is in the form of a voltage divider, for instance, in front of a certain input of the microprocessor required for determining the mass.

Advantageously, the method of the invention can also be used to estimate the remaining residual moisture in the load of laundry. To that end, during the spin cycle and/or at the end of a spin cycle, the sequence of the method of the invention can be employed once again and compared with the findings of the previous times that it was employed. In order to ascertain the residual moisture in the course of a spin cycle, the findings can be used to control the spin cycle itself, for example in such a way that when a predetermined value for the residual moisture is reached, the spin cycle is discontinued. Conversely, a value for the residual moisture ascertained at the end of a spin cycle that has run its course can be indicated, either in the form of a direct indication or display, or in the form of a recommendation for further treatment of the load of laundry.

The method of the invention has many advantages over the prior art. It is simple to perform, without using additional components. The findings of the mass determination enable more accurate detection of imbalances during the spin cycle that are detected by recognizing rpm fluctuations. A decision as to whether to stop an ongoing spin cycle and/or to repeat it can thus be made with more certainty. Detection of the mass of laundry by the method of the invention is maximally independent of tolerances in equipment components of the washing machine that have an influence on the water level, water pressure, inflow quantities, amplitude of vibration of the wash water holder unit, speed with which water is pumped out, and duration of different segments of cycles. The mass determination can be repeated at any time before and/or during the spin cycle and as a result offers manifold possible uses of the findings it produces.

We claim:

1. In a method for determining a mass of wet laundry in a washing machine drum being driven by an rpm-controlled universal motor, with the aid of controller variables, the improvement which comprises:

operating the drum no later than during a spin cycle within first, second and third phases in a mass determining operating segment, by:

operating the drum in the first phase with retarded acceleration of the drum up to a final rpm above an application rpm at which the laundry is applied to a wall of the drum, and near but below a resonant rpm of a drive system of the machine;

operating the drum in the second phase with a constant rated rpm equal to the final rpm; and operating the drum in the third phase with an rpm running down to a minimum rpm with the drive shut off, and with the minimum rpm still being high enough to prevent a previously developed ring of laundry from more than slightly separating from the drum wall; and measuring a length of time from a time when the drive is shut off until a time when the minimum rpm is reached, as a gauge for the mass of the laundry.

2. The method according to claim 1, which comprises determining a mean power of the drive motor during the second phase, as a gauge for a braking moment of the drum being taken into account as a variable in determining the mass.

3. The method according to claim 2, which comprises determining the capacity of the drive motor by determining a mean phase lead angle of an rpm control device, at a constant mains voltage.

4. The method according to claim 2, which comprises determining the capacity of the drive motor by determining a mean phase lead angle of an rpm control device, and during that time additionally measuring and taking the mains voltage into account as a correction value in the determination of the braking moment, at a mains voltage which is not constant.

5. The method according to claim 1, which comprises making at least one further mass determination during the spin cycle.

6. The method according to claim 5, which comprises comparing a value from the further mass determination with a value of a determination of a mass of the dry laundry carried out no later than at a beginning of a preceding washing process, for determining an ascertained spin action in the form of a value for any residual moisture still remaining.

7. The method according to claim 5, which comprises comparing a value from the further mass determination with a value from a preceding mass determination, and drawing a conclusion as to a residual moisture present in the further mass determination by using a value for a laundry absorption determination carried out no later than at a beginning of a preceding washing process.

* * * * *